United States Patent [19]

Lee

[11] Patent Number: 4,700,034

[45] Date of Patent: Oct. 13, 1987

[54] ELECTROMAGNETIC ENERGY SEAL OF A MICROWAVE OVEN

[75] Inventor: Hee J. Lee, Masan, Rep. of Korea

[73] Assignee: Goldstar Co., Ltd., Seoul, Rep. of Korea

[21] Appl. No.: 847,252

[22] Filed: Apr. 2, 1986

[30] Foreign Application Priority Data

Apr. 3, 1985 [KR] Rep. of Korea ..... 2249/1985

[51] Int. Cl.[4] ..... H05B 6/76

[52] U.S. Cl. ..... 219/10.55 D; 219/10.55 R; 174/35 R

[58] Field of Search ..... 219/10.55 D, 10.55 R; 174/35 R, 35 GC

[56] References Cited

U.S. PATENT DOCUMENTS 4,584,447 4/1986 Kusunoki et al. ..... 219/10.55 D

*Primary Examiner*—Philip H. Leung

*Attorney, Agent, or Firm*—Birch, Stewart, Kolasch & Birch

[57] ABSTRACT

A microwave leakage shielding apparatus of microwave oven which can cut off the leakage of high-frequency electromagnetic wave as well as that of second harmonic. The slot antenna is installed in such a manner that a serial resonant circuit is provided within the attenuating cavity of the choke installed in the door of microwave oven. Also, the apparatus can reduce the thickness of door by performing the one-quarter impedance inversion in the nearer position then λ/4 through the serial resonant circuit, thereby enlarging the capacity of heating room.

5 Claims, 9 Drawing Figures

ELECTROMAGNETIC ENERGY SEAL OF A MICROWAVE OVEN

BACKGROUND OF THE INVENTION

1. Field of the Invention

This invention generally relates to an electromagnetic energized microwave oven wherein the food is heated or cooked by transmitting a microwave from a magnetron to the heating room, and more particularly to a microwave leakage shielding apparatus of microwave oven wherein the serial resonant circuit is provided in the attenuating cavity of the choke in a door installed at the front of the microwave oven in order to cut off the leakage of microwave or high-frequency electromagnetic energy.

2. Description of the Related Art

The conventional microwave oven generally cooks or heats the food by using a high-frequency wave of 915 or 2450 megahertz. In most of the recent microwave ovens, the high-frequency wave of 2450 megahertz is being used.

In the cooking or heating of food by utilizing such high-frequency waves, it is very dangerous for the human to receive more than the order of 100 mw/cm$^2$ in his body, due to the leakage of such a high-frequency electromagnetic energy to the exterior of the microwave oven. Therefore, all countries of the world are restricting the leakage amounts of high-frequency electromagnetic energy to be less than the order of 5 mw/cm$^2$ a distance of 5 cm from the door at the worst state and are producing the microwave oven to be less than the order of 1 mw/cm$^2$. However, there developed a serious problem in that the high-frequency wave may leak through the gap between the door and the main body of the microwave oven caused by the release of a door hinge, etc. during the use thereof, or the gap between the door and the heating room caused by filth or remnants of food and the like, thereby causing human body harm.

In order to prevent the high-frequency wave from leaking through such gaps generated during the use of the oven, U.S. Pat. No. 2,500,676 suggests to shield the leakage of microwave energy by a metal-to-metal contact or the metallic contact between the door and the heating room. However, this suggestion has been found to have shortcomings in that the metal-to-metal contact is formed by a local point-contact, so that leakage of microwave energy is increased in proportion to the use time of products.

Further, U.S. Pat. No. 3,182,164 suggest to shield the leakage of microwave energy by utilizing the impedance inversion of $\lambda/4$ (herein, $\lambda$ is a wavelength of microwave). This has been found to have shortcomings in that the length for performing the ideal inversion is approximately the order of 32 mm in the microwave oven using a high-frequency wave of 2450 megahertz, and accordingly the thickness of the door becomes greater, so that it is very difficult to minimize the size of the products and lighten the weight thereof.

OBJECT OF THE INVENTION

Accordingly, it is an object of the present invention to shield the leakage of high-frequency electromagnetic waves as well as the leakage of second harmonic, by installing the slot antenna in such manner that a serial resonant circuit is provided within the attenuating cavity of a choke installed in the door of microwave oven.

It is another object of the present invention to reduce the thickness of the door of the microwave oven by performing the impedance inversion of $\lambda/4$ (herein, $\lambda$ is a wavelength of high-frequency electromagnetic wave or microwave) in the nearer position than $\lambda/4$ by means of the serial resonant circuit, thereby enlarging the capacity of the heating room.

SUMMARY OF THE INVENTION

In accordance with the present invention, there is provided with an apparatus for shielding the leakage of high-frequency electromagnetic waves from a microwave oven wherein a choke defining a microwave attenuating cavity is installed in the door provided at the front of a heating room and one side of the choke is fixed with a seal plate, one end of which, in turn, is bent toward the interior of the attenuating cavity, characterized in that a slot antenna with the shape of "∫" is installed within the attenuating cavity; slots with the width of $\lambda/16$ and the height of $\lambda/8$ are punched in the vertical portion of the antenna and at the interval of $\lambda/4$; the microwave concentrating cavities are defined in such a manner that the height of the inclined portion is $\lambda/48$ and both the height and the width are $\lambda/40$; and the bent portion of the seal plate is extended downwardly to cause its height to become $\lambda_2/4-\lambda_2/20$ (herein, $\lambda_2$ is a wavelength of the second harmonic).

BRIEF DESCRIPTION OF THE DRAWINGS

The foregoing and further objects and aspects of this invention will become more apparent from the following explanation of the embodiments with reference to the accompanying drawings, wherein.

DETAILED DESCRIPTION OF THE INVENTION

Firstly, the basic principle of door structure generally used will be explained with reference to FIGS. 1 and 2(A) and (B) prior to the detailed explanation of the present invention.

Figure 1:
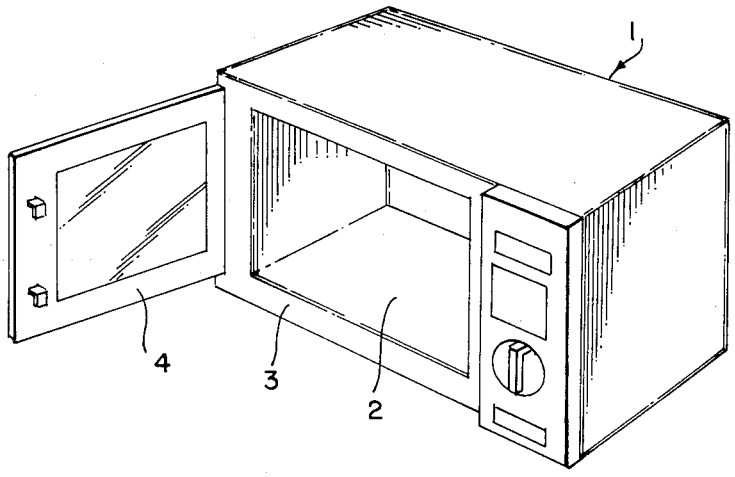
FIG. 1 is a perspective view of a conventional microwave or electronic range.

Referring now to FIG. 1 which is showing the perspective view of a conventional microwave oven, the heating room 2 is installed in one side of microwave oven 1, and a frame 3 and a door 4 are established and installed about the peripheral edge and in the front of a heating room 2, respectively.

In the microwave oven having the basic structure as described above, when the door 4 is closed, the heating room is sealed by the frame 3 and the door 4 to cut off the leakage of microwave; however, a thin film of dielectric is generally defined in the contact area of between frame 3 and door 4 and also a complete metal-to-metal contact is not made due to a gap between the frame 3 and the door 4 originated from long time use, so that this results in the microwave within the heating room 2 being leaked.

One technique for preventing the leakage of microwave is the one-quarter wavelength or $\lambda/4$ impedance inversion which is to install the serial resonant circuit in such a manner that a resonant short circuit is established in the leakage passway of the microwave. Hereafter, this impedance inversion technique will be explained in detail.

Figure 2A:
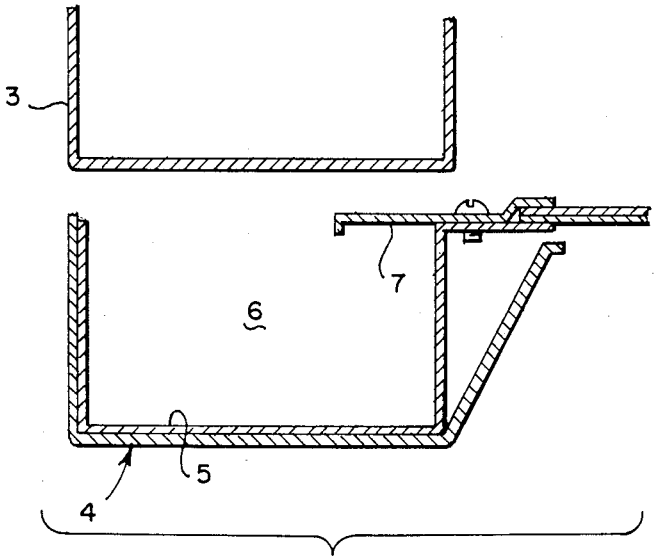
FIGS. 2(A) and 2(B) are enlarged sectional views of a portion of the door and the schematic representation for explaining the basic principle of door the structure respectively, in which both are shown for explaining the door structure of a conventional microwave oven.
Figure 2B:
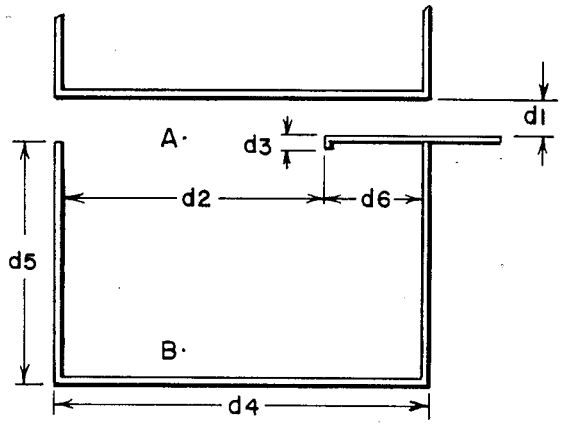
Figure 3:
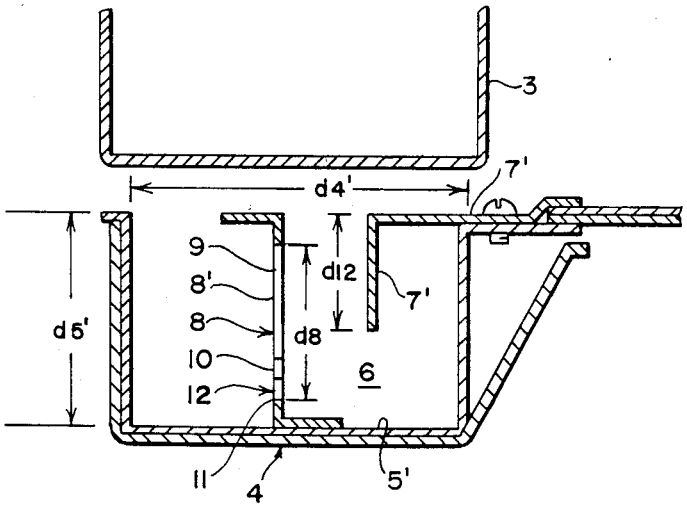
FIG. 3 is a partly enlarged sectional view showing the door structure of the microwave leakage shielding apparatus according to the present invention.
Figure 4:
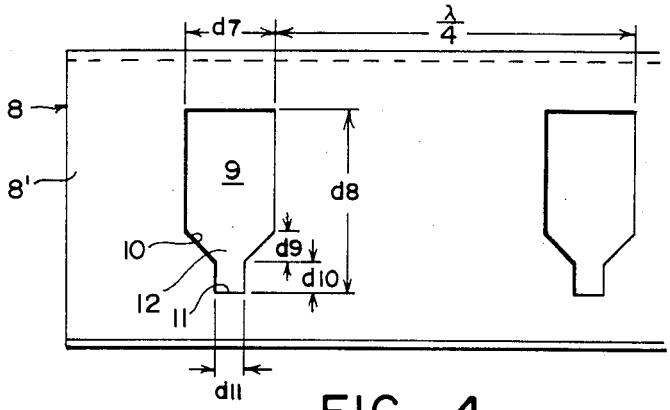
FIG. 4 is a front view showing extractively the slot antenna which is the main part of the microwave leakage shielding apparatus according to the present invention.

Referring now to FIGS. 2(A) and (B) which show the partial section of the door 4 and a schematic diagram for explaining door a basic principle of door structure, the capacitance element is provided in the microwave leakage direction between a frame 3 and the choke 5 of the door 4 and at the distance of one-quarter wavelength while an inductive element is provided in the direction vertical to the leakage direction, whereby establishing the serial resonant short circuit to define the microwave attenuating cavity 6 is referred to the one-quarter wavelength impedance inversion. The impedance $Z_A$ looking from a point A toward a point B is represented as follows:

$$Z_A = jZ_0 \tan 2\pi/\lambda \cdot l$$

wherein, $Z_0$ is the characteristic impedance and l is the distance between the point A and point B.

In the above equation, if the short-circuit state of point the B is taken as the reference, then it is found that when the distance l between the point A and B is $\lambda/4$, the impedance $Z_A$ goes to the infinite value, and thus the impedance is reversed and accordingly the leakage of microwave is cut off.

However, in the above expression, the capacitance in the microwave leakage direction is varied by a contact distance $d_1$ between the frame 3 and a seal plate 7, an access distance $d_2$ of an attenuating cavity 6 and an intrusion distance $d_3$ from the plate 7 to the attenuating cavity 6, so that in real effect when a width $d_4$ of the attenuating cavity 6 becomes $1.2\times\lambda/4$ and a height $d_5$ of it becomes $0.8\times\lambda/4$, the minimized leakage of microwave is obtained.

Further, the characteristic given when the access distance $d_2$ is $0.7\times\lambda/4$ and the contact distance $d_6$ between the frame 3 and the seal plate 7 is $0.3\times\lambda/4$ and the characteristic given when the access distance $d_2$ is $0.4\times\lambda/4$ and the contact distance $d_6$ is $0.6\times\lambda/4$, is different each other. That is, in the former case the microwave leakage is exponentially increased while in a latter case the microwave leakage is linearly increased, in proportion to the increase of the contact distance $d_1$.

However, in the door 4 with the basic structure as described above, the perfect metal-to-metal contact is not made, that is, the gap is produced between the frame 3 and the door 4, and also the microwave must be propagated only in the direction of attenuating cavity 6, so that it is found that the microwave leakage can not be shielded completely and at the same time the second harmonic with a lot of energy radiated at the initial time of microwave oven operation can not be cut off.

Hereafter, the embodiments of the present invention will be explained in detail with reference to FIGS. 3, 4, 5(A), 5(B) and 6.

In the microwave leakage shielding apparatus of micro-oven wherein a choke 5' defining the microwave attenuating cavity 6' is installed in the door 4 provided at the front of heating room 2, and one side of the choke 5' is fixed with a seal plate 7', one edge of which, in turn, is bent toward the interior of the attenuating cavity 6', the apparatus includes a slot antenna 8 with the shape of "∫" installed within the attenuating cavity 6'; slots 9 with the width $d_7$, of $\lambda/16$ and a height $d_8$ of $\lambda/8$ being punched in a vertical portion 8' of the antenna 8 and at a interval of $\lambda/4$; the micro-wave concentrating cavity 12 being defined in such a manner that in the lower part of each slots 9 the height $d_9$ of inclined portion 10 is $\lambda/48$, and both the height $d_{10}$ and the width $d_{11}$ of the neck portion 11 are $\lambda/48$; and the bent portion 7'' of the seal plate 7' extended downwardly to cause its height $d_{12}$ to become $\lambda_2/4-\lambda_2/20$ (herein, $\lambda_2$ is a wavelength of second harmonic).

Now, the operation and working effects of the present invention as described above will be explained in detail.

The microwave entering to the attenuating cavity 6' is concentrated at the concentrating cavity 12 in each slot 9 of the slot antenna 8 and accordingly the phase of the electric field distribution of microwave is controlled at the period interval of the slots 9. In other words, if the period interval of the slots 9 is $\lambda/2$; then the phase of electric field distribution of microwave entering in a width or traverse direction of the attenuating cavity 6' is distributed in the width direction thereof; and if the period interval of the slots 9 is $\lambda/4$, then the phase of the electric field distribution of microwave entering in to a length or longitudinal direction thereof is distributed in a length direction of the attenuation cavity 6'.

Herein, the slot antenna 8 of the present invention has the slots 9 defined at the period interval of $\lambda/4$, so that the microwaves entering at each different angle are diffracted in the length direction of attenuating cavity 6' and thus the distribution is rearranged in the form of a sine wave. In other words, the electric field distribution of microwave is uniformly distributed in the length direction of attenuating cavity 6' by the serial resonances of attenuating cavity 6' caused by the slot antenna 8, thereby reducing the leakage of microwave.

Further, the height $d_{12}$ of the bent portion 7'' of the seal plate 7' is established as $\lambda_2/4-\lambda_2/20$ to operate as a serial resonant short circuit of the diphased microwave or the second harmonic generated at the initial time of microwave oven operation, so that the leakage of the second harmonic is restricted.

In the mean time, the slot antenna 8 allows the equivalent serial inductance within the attenuating cavity 6 to be increased to reduce the width $d_4'$ of attenuating cavity 6, and also the length of bent portion 7' of seal portion 7 is long enough to increase the equivalent capacitance and to shorten the equivalent travelling distance, thereby allowing the depth $d_5'$ of attenuating cavity 6 to be shorten into less than $\lambda/4$, or practically to be lessen up to $\lambda/5$ and accordingly reducing the entire dimension of the attenuating cavity.

Figure 5A:
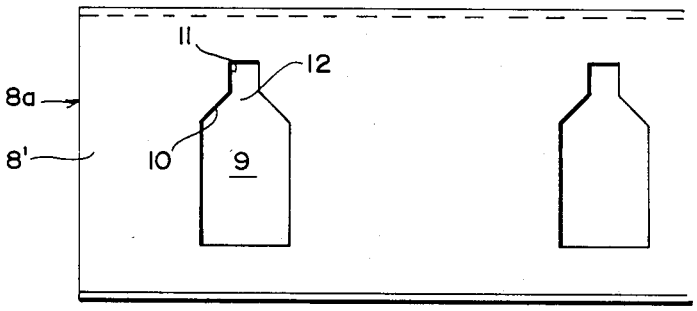
FIGS. 5(A) to (C) are the front views showing another embodiment of the microwave leakage shielding apparatus according to the present invention.
Figure 5B:
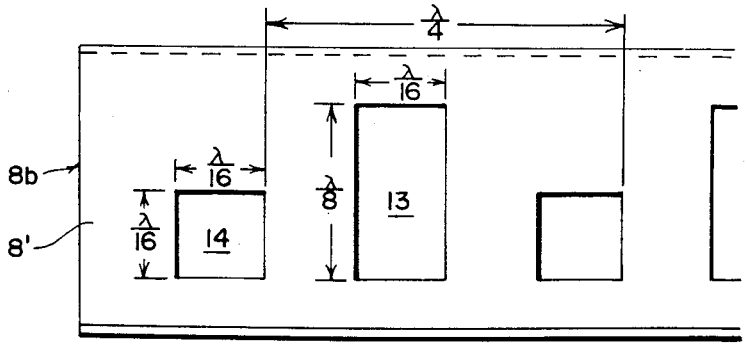
Figure 5C:
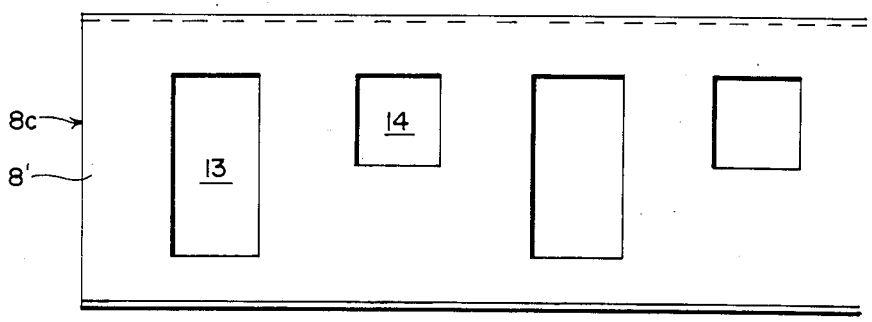

In the implementation of the present invention, a slot antenna 8*a* may be constructed by defining the concentrating cavity 12 in the upper part of the slots 9, as shown in FIG. 5(A), to obtain the same effects as described above, instead of defining the concentrating cavity 12 in the lower part of slots 9. Also, a slot 13 may be defined in such a manner that it has the width of λ/16 and the length of λ/8 in the vertical portion 8 of slot antennas 8*b*, 8*c*; and a slot 14 may be defined in such a manner that it has the width and length of λ/16 in the lower or upper part between each slot 13, as shown in FIGS. 5(A) and 5(B) respectively, in order to attenuate the leakage of second harmonic.

Figure 6:
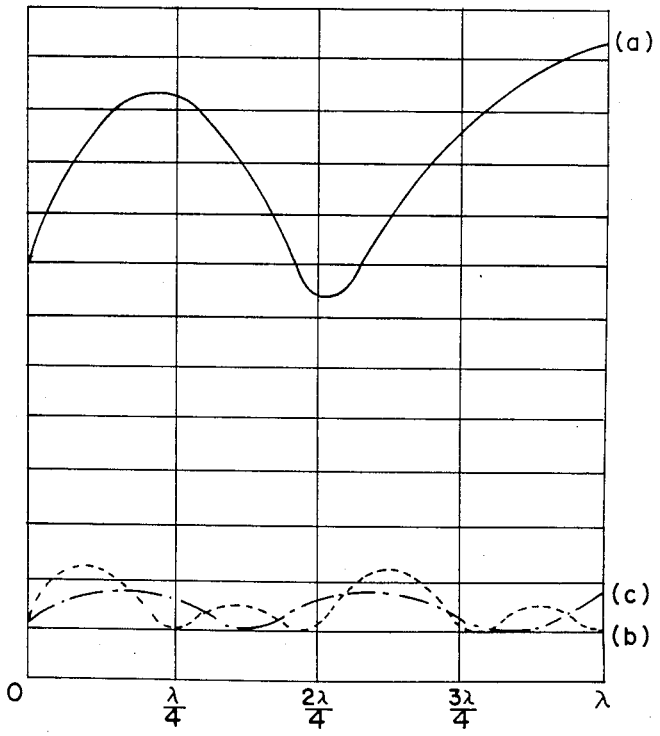
FIG. 6 is a graph representing the leakage amounts of microwave in the prior art microwave leakage shielding apparatus and those of the present microwave leakage shielding apparatus.

Referring now to the graph in FIG. 6 in which the leakage amounts of microwave in an microwave oven installing the slot antenna 8, 8*a* and 8*b*, 8*c* according to the present invention and those of microwave in an microwave oven having the conventional door structure 4 are comparatively measured when the space between the frame 3 and the door 4 is of the order of 1 mm, it is found that the leakage amount b of microwave in microwave oven according to one embodiment of the present invention installing the slot antennas 8, 8*a* is greatly reduced as compared with the leakage amounts a of microwave in the microwave oven having the conventional door structure 4, and also that the leakage amounts c of microwave in the micro-oven installing the slot antenna 8*b*, 8*c* according to another embodiment of the present invention has more reduction than any one of the leakage amounts a and b.

In accordance with the present invention, as described above, the slot antennas 8, 8*a*,8*b*, 8*c* is installed within the attenuating cavity 6′ to diffract the microwave entering the attenuating cavity 6′ in its length direction and accordingly to distribute the electric field uniformly so that it has advantages in that the leakages of microwave can be greatly reduced and the leakage of the second harmonic emitted at the initial time of microwave oven operation also can be reduced. In addition, it has another advantage in that the width and depth of attenuating is reduced so that the entire volume of the door 4 can be reduced and accordingly the capacity of the heating room is expanded, and also that the appearance of microwave oven may be become elegant.

While the invention has been described in its preferred embodiments, it is to be understood that modifications and variations will be apparent to those skilled in the art without departing from the spirit of the invention.

The scope of the invention, therefore, is to be determined solely by the following claims.

What is claimed is:

1. A microwave oven which comprises in combination:

a heating room surrounded by a frame on the front portion thereof, means for energizing said heating room by electromagnetic wave, a door having an attenuating cavity housed therein, hinged on said frame such that when said door is closed, said heating room is sealed by contact between said frame and said door, a choke portion disposed in said attenuating cavity of said door, a seal plate fixed in one side of said choke having an end portion bent toward the interior of said attenuating cavity, a slot antenna positioned in said attenuating cavity having a vertical portion with two horizontal portions each extending in opposite directions from respective ends of said vertical portion, said slot antenna being provided with a serial resonant circuit for preventing high frequency electromagnetic wave and second harmonics from leaking from the heating room, and a plurality of slots disposed on said vertical portion of said slot antenna, each of said plurality of slots being disposed at an interval of ¼ of the wavelength (λ) of electromagnetic wave, having a width of λ/16 and height of λ/8.

2. The microwave oven of claim 1, wherein the slot is formed with a microwave concentrating cavity having an inclined portion with the height of λ/48 and a neck portion with the height and width of λ/48.

3. The microwave oven of claim 1, wherein one end portion of said seal plate extends downwardly by the height of $\lambda_2/4-\lambda_2/20$, said $\lambda_2$ being wavelength of second harmonic.

4. The microwave oven of claim 1, wherein the slots are respectively formed upside down such that the microwave concentrating cavity is disposed at the upper part of each of the slots in the direction of the slots in the direction of the heating room.

5. A microwave oven which comprises in combination:

a heating room surrounded by a frame on the front portion thereof, means for energizing said heating room by electromagnetic wave, a door having an attenuating cavity housed therein, hinged on said frame such that when said door is closed, said heating room is sealed by contact between said frame and said door, a choke portion disposed in said attenuating cavity of said door, a seal plate fixed in one side of said choke having an end portion bent toward the interior of said attenuating cavity, a slot antenna positioned in said attenuating cavity having a vertical portion with two horizontal portions each extending in opposite directions from respective ends of said vertical portion, said slot antenna being provided with a serial resonant circuit for preventing high frequency electromagnetic wave and second harmonics from leaking from the heating room, and a plurality of slots disposed on said vertical portion of said slot antenna, each of the plurality of slots comprising a square slot portion having side length of λ/16 and an oblong slot portion separate from said square slot portion having a length of λ/8 and width of λ/16, said plurality of slots being formed in an interval of λ/4, and said squre portions being formed in the vincinity of either a lower part of said vertical portion away from the heating room or an upper part of the vertical portion in the direction of the heating room.

* * * * *